US009735486B1

(12) United States Patent
Yu et al.

(10) Patent No.: US 9,735,486 B1
(45) Date of Patent: Aug. 15, 2017

(54) ELECTRICAL CONNECTOR

(71) Applicant: ALLTOP ELECTRONICS (SUZHOU) LTD., Taicang, JiangSu Province (CN)

(72) Inventors: Wang-I Yu, New Taipei (TW); Li-Li Liang, New Taipei (TW); Yong-Gang Zhang, New Taipei (TW); Yung-Chih Hung, New Taipei (TW); Yu-Hui Zhang, New Taipei (TW); Hai-Feng Ren, New Taipei (TW)

(73) Assignee: ALLTOP ELECTRONICS (SUZHOU) LTD., Taicang, JiangSu Province (CN)

( * ) Notice: Subject to any disclaimer, the term of this patent is extended or adjusted under 35 U.S.C. 154(b) by 0 days.

(21) Appl. No.: 15/232,992

(22) Filed: Aug. 10, 2016

(30) Foreign Application Priority Data

May 6, 2016 (CN) ..... 2016 1 0296947

(51) Int. Cl.

| | |
|---|---|
| ***H01R 12/00*** | (2006.01) |
| ***H01R 12/70*** | (2011.01) |
| ***H01R 13/627*** | (2006.01) |
| ***H01R 13/629*** | (2006.01) |
| ***H01R 13/506*** | (2006.01) |

(52) U.S. Cl.
CPC ..... *H01R 12/707* (2013.01); *H01R 13/506* (2013.01); *H01R 13/629* (2013.01); *H01R 13/6272* (2013.01)

(58) Field of Classification Search
CPC H01R 12/707; H01R 13/6272; H01R 13/506; H01R 13/629
USPC ..... 439/65, 67, 77, 79
See application file for complete search history.

(56) References Cited

U.S. PATENT DOCUMENTS

| | | | | |
|---|---|---|---|---|
| 5,934,933 | A * | 8/1999 | Kordecki | H01R 12/777 439/271 |
| 6,159,023 | A * | 12/2000 | Lai | H01R 12/7017 439/607.01 |
| 8,636,533 | B1 * | 1/2014 | Yen | H01R 12/732 439/325 |
| 2009/0291596 | A1 * | 11/2009 | Miyazoe | H01R 12/721 439/636 |
| 2011/0237101 | A1 * | 9/2011 | Yang | H01R 12/721 439/153 |

* cited by examiner

*Primary Examiner* — Khiem Nguyen
(74) *Attorney, Agent, or Firm* — Sughrue Mion, PLLC

(57) ABSTRACT

An electrical connector includes an insulative housing, a plurality of contacts retained in the insulative housing and a fastener. The insulative housing has a rear surface. Each contact has a connecting leg extending beyond the rear surface. The connecting legs are arranged in at least a row, and each connecting leg has a connecting portion and a resisting portion. The fastener has at least a contact receiving chamber, a flexible circuit board receiving chamber communicating with the contact receiving chamber and a press section. The contact receiving chamber is arranged between from the flexible circuit board receiving chamber and the press section. Wherein the fastener has a fixed position on the insulative housing, and as moving the fastener to the fixed position, the press section presses the resisting portion to drive the connecting portion projecting into the flexible circuit board receiving chamber.

19 Claims, 18 Drawing Sheets

ELECTRICAL CONNECTOR

BACKGROUND

1. Technical Field

The present disclosure relates to an electrical connector, and more particularly to an electrical connector facilitating a flexible circuit board to be installed.

2. Description of Related Art

At present, an electrical connector mainly includes a housing and a plurality of terminals retained in the housing. The terminals generally are provided with soldering legs for connecting with a circuit board. The configurations of the terminals are different according to variety applications. The soldering between the terminals and the circuit board is difficult to be operated under the situation of more terminals or limited installing space of insulative housing or circuit board.

It is desirable to provide an improved electrical connector for solving above problems.

SUMMARY

In one aspect, the present invention includes an electrical connector. The electrical connector includes an insulative housing, a plurality of contacts retained in the insulative housing and a fastener. The insulative housing has a top surface, a bottom surface and a rear surface. Each contact has a connecting leg extending beyond the rear surface. The connecting legs of the contacts are arranged in at least a row, and each connecting leg has a connecting portion and a resisting portion adjacent to the connecting portion. The vertical distance between the connecting portion and the top wall is different from that between the resisting portion and the top wall. The fastener has at least a contact receiving chamber, a flexible circuit board receiving chamber communicating with the contact receiving chamber and a press section. The contact receiving chamber is arranged between from the flexible circuit board receiving chamber and the press section. The resisting portion is far from the flexible circuit board receiving chamber than the connecting portion, and abuts against the press section when the fastener is fixed to the insulative housing. Wherein the fastener has a fixed position on the insulative housing, and as moving the fastener to the fixed position, the press section presses the resisting portion to drive the connecting portion projecting into the flexible circuit board receiving chamber.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
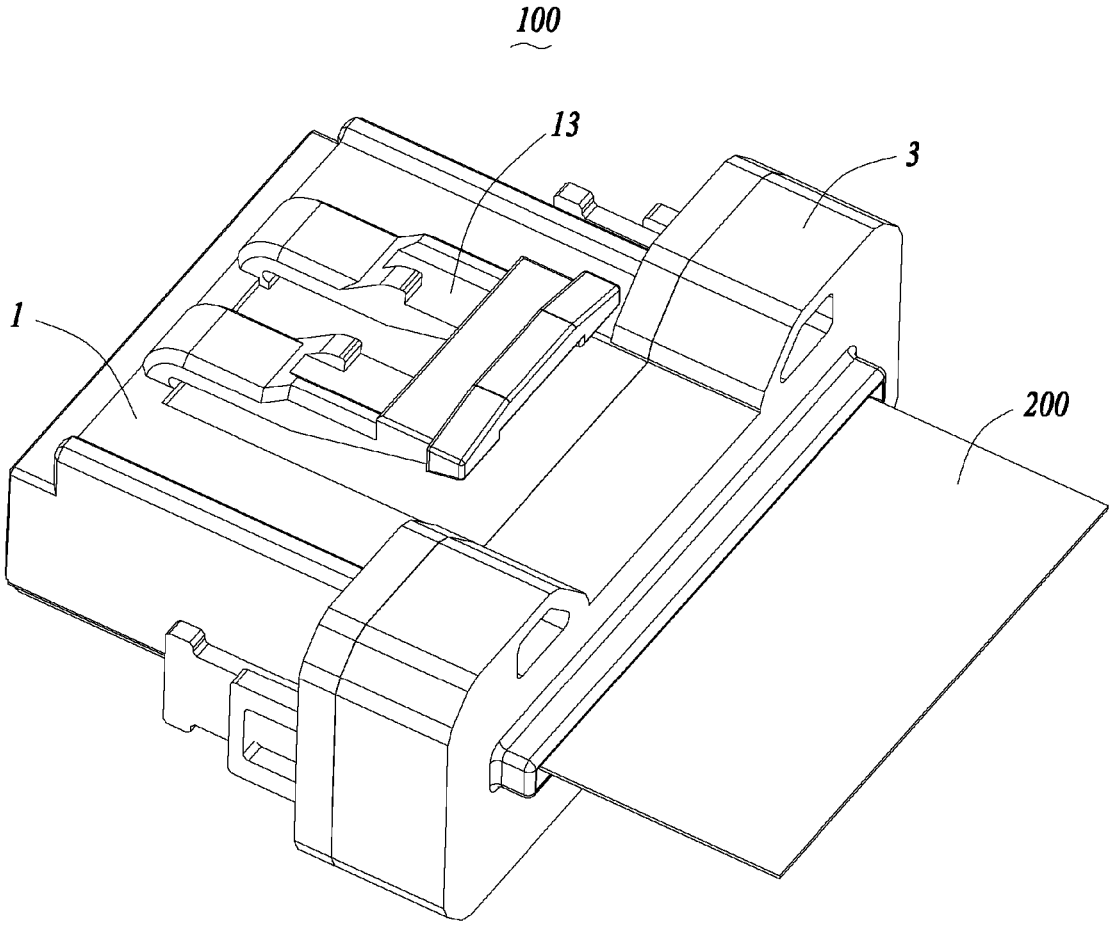
FIG. 1 is a perspective view illustrating a first embodiment of an electrical connector connected with a flexible circuit board in the present disclosure.

Reference will now be made to the drawing figures to describe the embodiments of the present disclosure in detail. In the following description, the same drawing reference numerals are used for the same elements in different drawings.

Referring to FIGS. 1 to 5, a first illustrated embodiment of the present disclosure discloses an electrical connector 100. The electrical connector 100 is used to electrically connect with a flexible circuit board 200, and comprises an insulative housing 1, a plurality of contacts 2 retained in the insulative housing 1 and a fastener 3.

Figure 2:
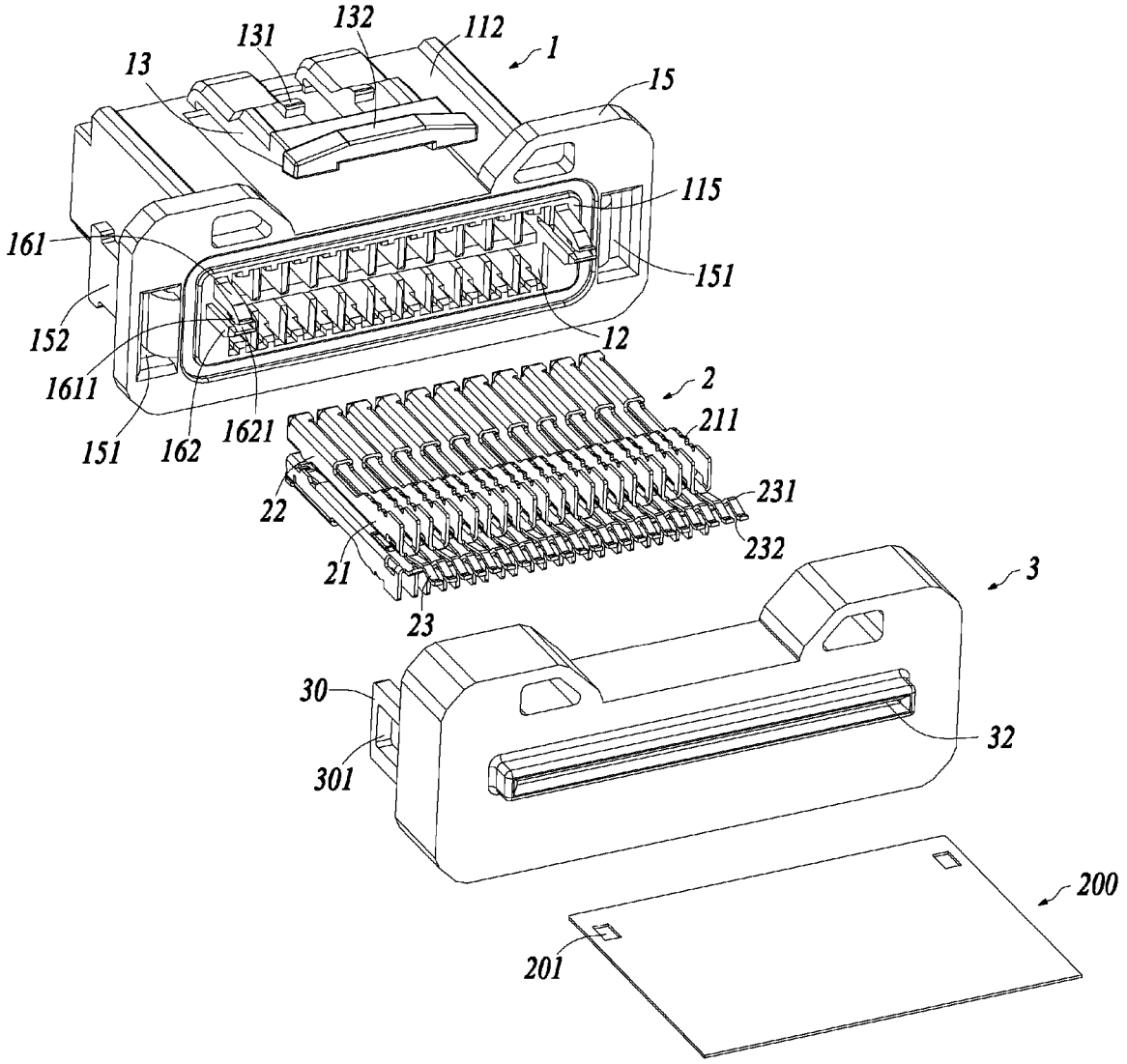
FIG. 2 is an exploded view of the electrical connector and the flexible circuit board shown in FIG. 1.
Figure 3:
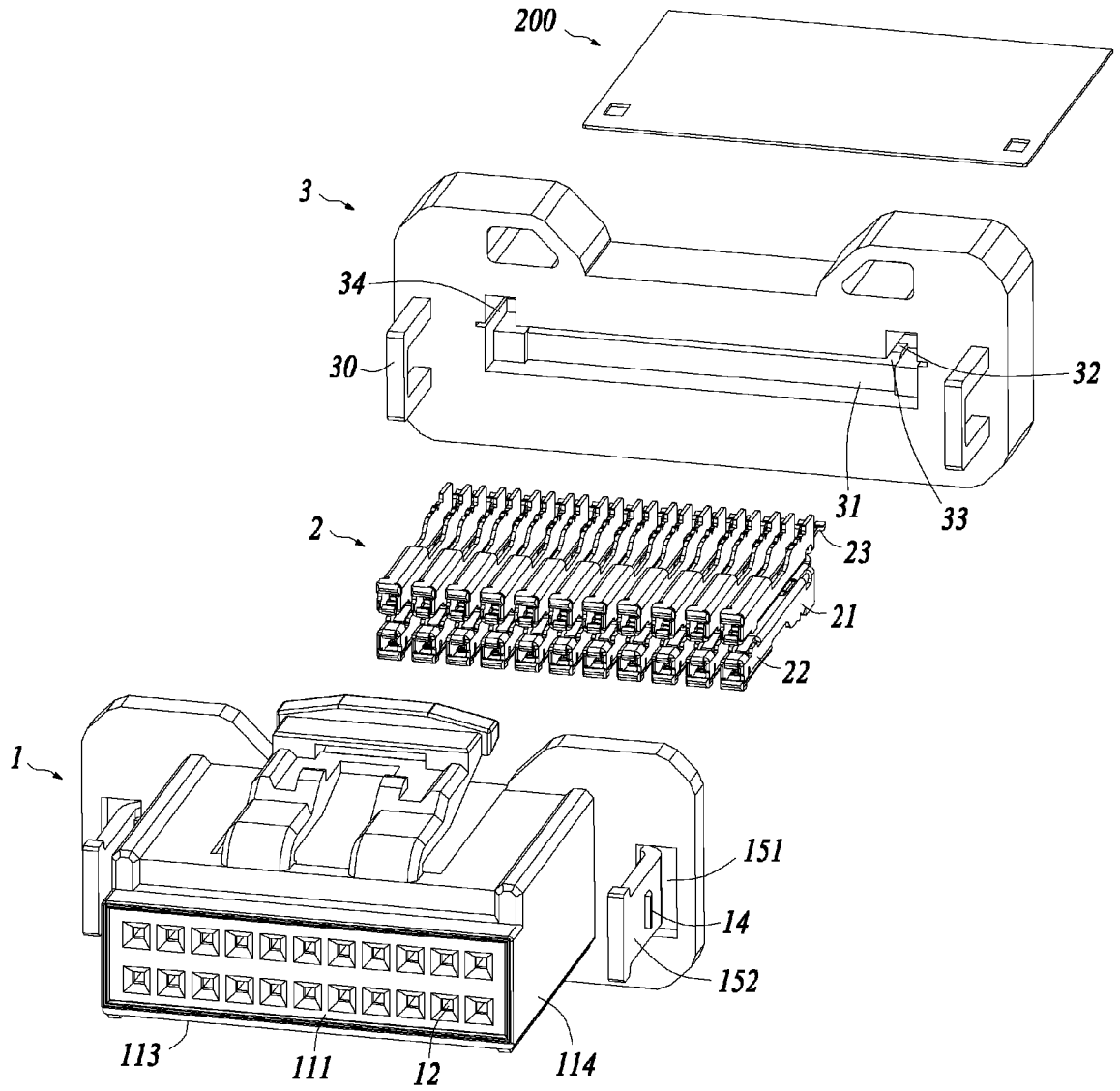
FIG. 3 is a view similar to FIG. 2, while viewed from another aspect.
Figure 4:
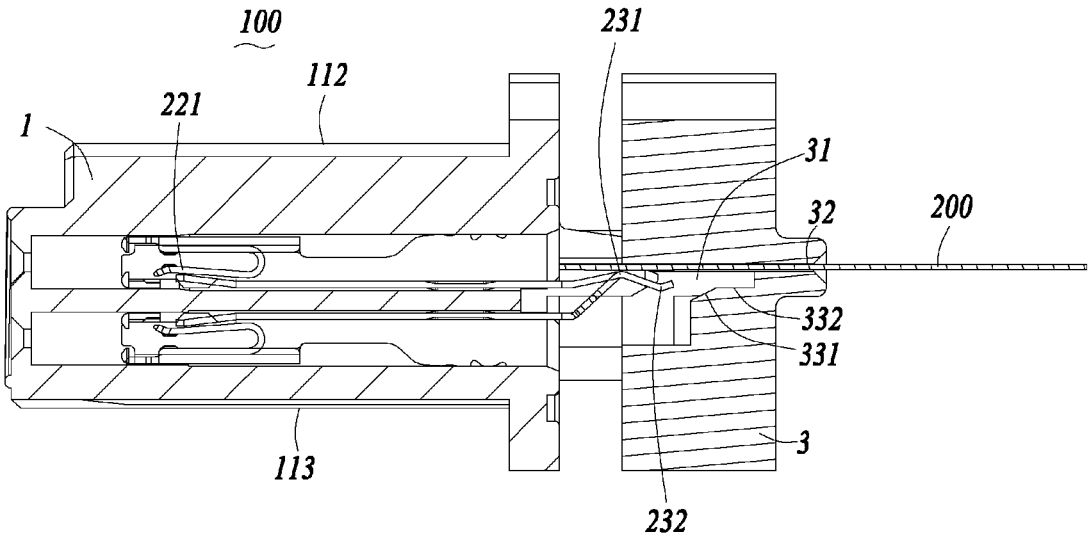
FIG. 4 is a cross-sectional view of the electrical connector and the flexible circuit board, shown that the electrical connector is in a pre-fixing state and the connecting legs of the contacts do not connect with the flexible circuit board.
Figure 5:
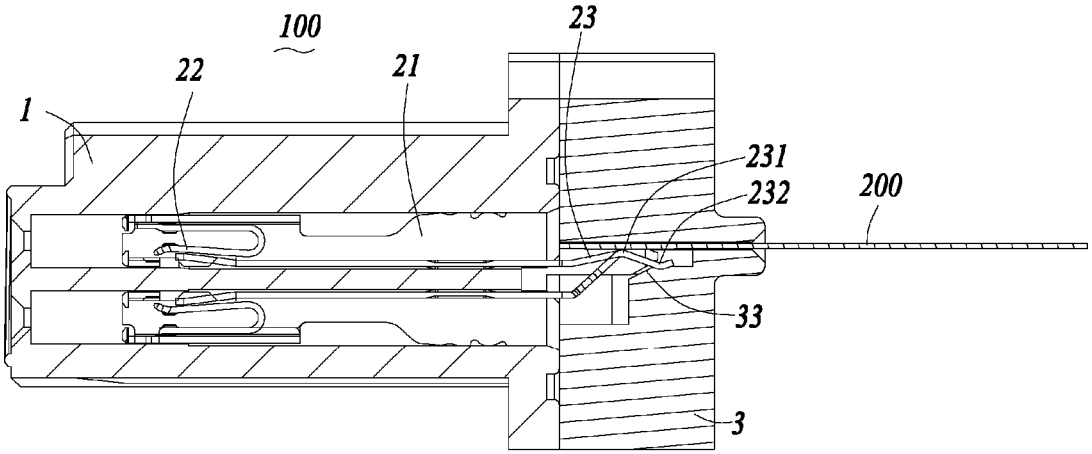
FIG. 5 is a cross-sectional view of the electrical connector and the flexible circuit board, shown that the electrical connector is in a fixing state, and the connecting legs of the contacts connect with the flexible circuit board.

Please refer to FIGS. 1 to 3, the insulative housing 1 has a front end surface 111, a top surface 112, a bottom surface 113, two side surfaces 114, a rear surface 115 and a plurality of passageways 12 extending through the front end surface 111 and the rear surface 115 along a front to back direction. The passageways 12 are arranged in two rows along a top to bottom direction. The insulative housing 1 further has a latching arm 13 at the top side thereof for locking a mating connector (not shown). The latching arm 13 extends upwardly and backwardly from the top surface 112, and is formed with a latching projection 131 at the top side thereof and an operation portion 132 at the rear side thereof.

The insulative housing 1 is provided with a fixing structure 14 at a rear side thereof. The fastener 3 has a fitting section 30 to fit with the fixing structure 14. When the fixing structure 14 fits with the fitting section 30, the fastener 3 is secured to a fixed position of the insulative housing 1.

In the first embodiment, the insulative housing 1 is formed with an enlarged portion 15 outwardly extending from the rear sides of the top wall 112, bottom wall 113 and two side walls 114. The enlarged portion 15 defines two fixing holes 151 extending therethrough along the front to back direction and a pair of fixing plates 152 forwardly extending through the fixing holes 151. Said two fixing holes 151 are disposed at outsides of two side walls 114 respectively. The fixing plates 152 forwardly extend from the internal walls of the fixing holes 151. Said internal walls are adjacent to the side walls 114. The fixing structure 14 is formed on the fixing plates 152 and presented as a pair of fixing projections projecting outwardly.

Besides, referring to FIGS. 2 and 3, the insulative housing 1 further has a pair of limiting elements to lock the flexible circuit board 200 and limit the flexible circuit board 200 from moving backwardly. In detail, the limiting elements are formed between the passageways 12 and the fixing holes 151, and are presented as a pair of spring arms 161 backwardly extending from the rear surface 115. Each spring arm 161 is provided with a protrusion 1611 at a free end thereof for positioning the flexible circuit board 200. The protrusion 1611 has a guiding surface at a rear side thereof. The flexible circuit board 200 defines a pair of openings 201 to engage with the protrusions 1611. Besides, the limiting elements further have a pair of supporting arms 162 preferably. The supporting arms 162 align with the spring arms 161 along the top to bottom direction. Each supporting arm 162 defines a recess 1621 corresponding to the protrusions 1611. The spring arms 161 and the supporting arms 162 define a gap therebetween to receive the flexible circuit board 200.

Referring to FIGS. 1 to 4, in the first embodiment, the contacts 2 are assembled to the insulative housing 1 from the rear surface 115 along a back-to-forward direction. Each contact 2 has a retaining portion 21 retained in the passageways 12, a contact portion 22 forwardly extending from the retaining portion 21 and a connecting leg 23 backwardly extending beyond the rear surface 115.

The retaining portions 21 and the contact portions 22 are arranged in two rows corresponding to the passageways 12. The retaining portions 21 are U-shaped and formed with a plurality of barbs 211 to friction engage with the inner walls of the passageways 12. The contact portions 22 are bended to rectangular tubular shape for receiving a mating pin. Each contact portion 22 is formed with a clamping arm 221 at an inner side thereof to clamp the mating pin.

In the first embodiment, all the connecting legs 23 are arranged in a row. In detail, the connecting legs 23 corresponding to the lower row of the contact portions 22 bend upwardly to be located in a row with the other connecting legs 23. Each connecting leg 23 has a connecting portion 231 for connecting with the flexible circuit board 200 and a resisting portion 232 adjacent to the connecting portion 231. The vertical distance between the connecting portion 231 and the top wall 112 is different from that between the resisting portion 232 and the top wall 112.

In the first embodiment, the connecting portions 231 are close to the rear surface 115 and protruding upwardly. The resisting portions 232 extending backwardly and downwardly from the rear side of the connecting portions 231. The connecting portions 231 can be drove to move upwardly when the resisting portions 232 are pressed upwardly. The free ends of the connecting legs 23 and the resisting portions 232 are located at different plane.

Referring to FIGS. 2 to 5, the fastener 3 has a contact receiving chamber 31 to receive the connecting legs 23, a flexible circuit board receiving chamber 32 communicating with the contact receiving chamber 31, and a press section 33. The contact receiving chamber 31 is arranged between the flexible circuit board receiving chamber 32 and the press section 33. The resisting portions 232 are far from the flexible circuit board receiving chamber 32 than the connecting portions 231, and abut against the press section 33 when the fastener 3 is fixed to the insulative housing 1. In the process of the fastener 3 moving to the fixed position of the insulative housing 1, the press section 33 presses the resisting portions 232 gradually to drive the connecting portions 231 moving into the flexible circuit board receiving chamber 32 and connecting with the flexible circuit board 200.

In the first embodiment, the fastener 3 is an unitary mold. The contact receiving chamber 31 is recessed from the front end of the fastener 3 and presented as a long groove extending along a transverse direction. The flexible circuit board receiving chamber 32 is located at an upper side of the contact receiving chamber 31 and extends through the fastener 3 along the front to back direction. The press section 33 is an internal wall of the contact receiving chamber 31. The fastener 3 further has a resisting wall 333 opposite to the press section 33. The press section 33 is provided with an inclined guiding wall 331 at a front side thereof and a level press wall 332 extending backwardly. When the fastener 3 is moving to the fixed position, the inclined guiding wall 331 abuts against the resisting portions 232 firstly and presses the resisting portions 232 gradually, then the connecting portions 231 can be drove to protrude into the flexible circuit board receiving chamber 32. When the press wall 332 moves to engage with the resisting portions 232, the connecting portions 231 connect with the flexible circuit board 200 and sandwich the flexible circuit board 200 with the resisting wall 333, then the connection is maintained.

Besides, the fitting section 30 is presented as a pair of fixing arms extending forwardly from two sides of the fastener 3. The fixing arms extend beyond the front end of the fastener 3. Each fixing arm defines a fitting hole 301 to engage with the fixing projection of the fixing plate 151. Of course, the fitting section 30 can be designed as a pair of fixing arms each of which has a fitting protrusion to hook the fixing projection. Moreover, the fastener 3 further defines a pair of cavities 34 between the fitting section 30 and contact receiving chamber 31. The limiting elements are received in the cavities 34 when the fastener 3 is positioned to the fixed position.

In addition, the fastener 3 further has a pre-fixed position on the insulative housing 1. The pre-fixed position is located behind the fixed position. When the fastener 3 is assembled to the pre-fixed position, the connecting legs 23 are received in a front side of the contact receiving chamber 31, and the press section 33 aligns with the resisting portions 232 along the top to bottom direction and does not yet pressing the resisting portions 232.

In the present embodiment, at the pre-fixed position, the fitting section 30 protrudes into the fixing holes 151 and has not locked with the fixing structure 14; while the fitting section 30 abuts against the fixing plates 152 and is sandwiched between the fixing plates 152 and the opposite inner wall of the fixing hole 151. Then the fastener 3 is pre-fixed to the pre-fixed position.

In using, firstly, assembling the fastener 3 to the pre-fixed position, at this position, each part of the fastener 3 corresponds to the corresponding structures of the insulative housing 1 one to one; secondly, inserting the flexible circuit board 200 into the flexible circuit board receiving chamber 32 with zero insertion force, and making the flexible circuit board 200 protrude to a position at where the golden fingers of the flexible circuit board 200 correspond to the connecting legs 23 along the top to bottom direction, at the point the limiting elements lock with the openings 201 of the flexible circuit board 200 to prevent the flexible circuit board 200 from moving backwardly; thirdly, moving the fastener 3 from the pre-fixed position to the fixed position, the connecting portions 231 can be drove to connect with the golden fingers of the flexible circuit board 200 gradually in the moving process, and the flexible circuit board 200 will be sandwiched between the connecting portions 231 and the resisting wall 330 finally, and the fastener 3 is maintained at the fixed position by the fixing structure 14 and the fitting section 30.

As described above, in the present invention, the flexible circuit board 200 and the contact 2 can connect with each other without welding, and the connecting can be stably maintained via the engagement of the fastener 3 and the insulative housing 1. Besides, the design of the electrical connector 100 is simple and convenient to assemble and position the flexible circuit board 200.

Figure 6:
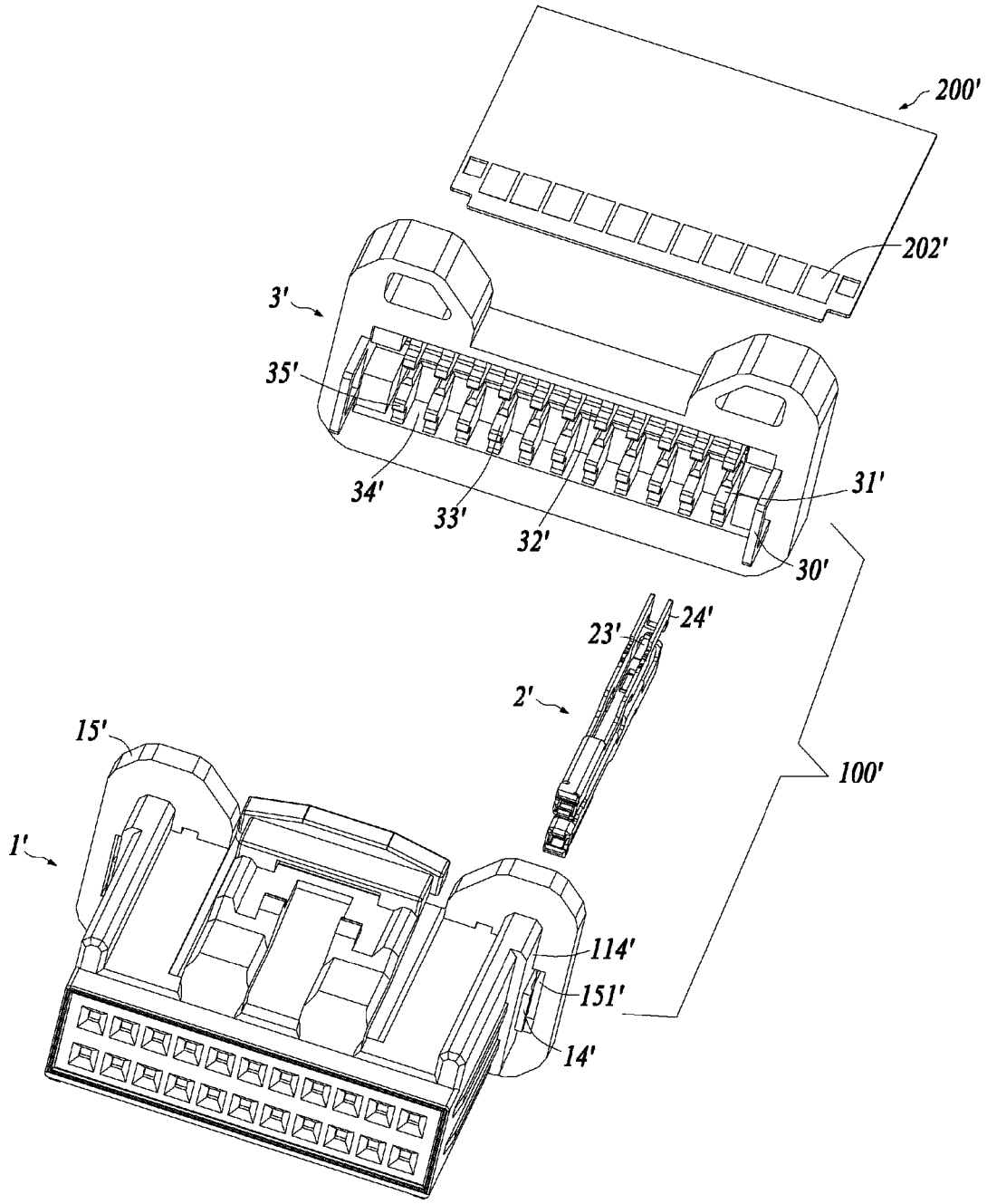
FIG. 6 is a partially exploded view illustrating a second embodiment of an electrical connector and a flexible circuit board in the present disclosure.
Figure 7:
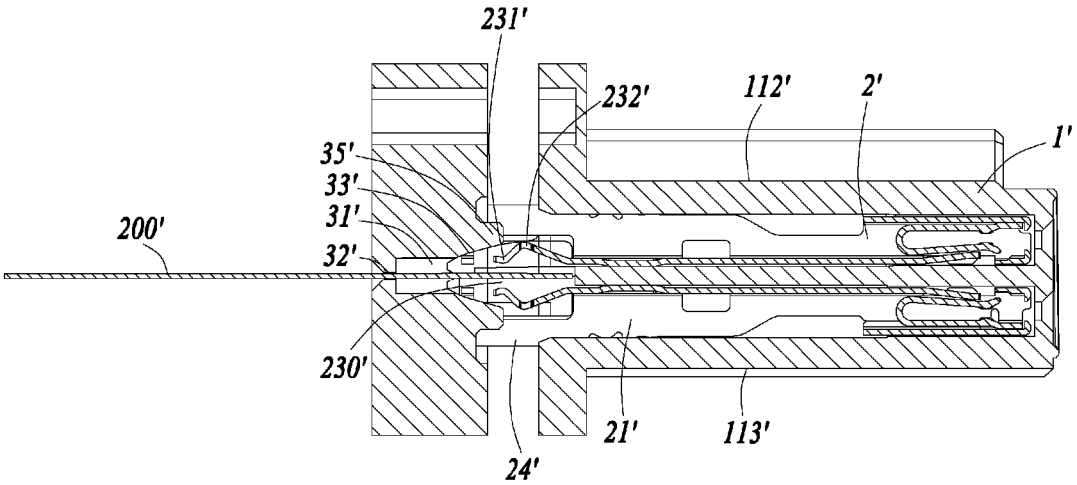
FIG. 7 is a cross-sectional view of the electrical connector and the flexible circuit board shown in FIG. 6, and shown that the electrical connector is in a pre-fixing state and the connecting legs of the contacts do not sandwich the flexible circuit board.
Figure 8:
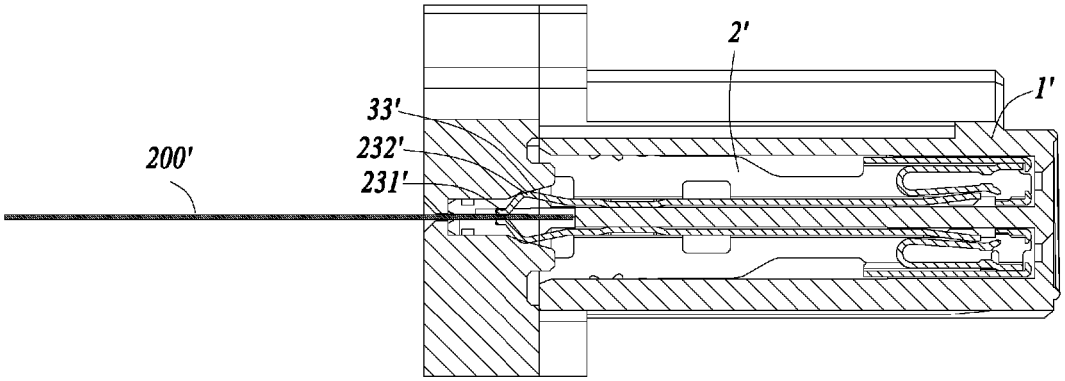
FIG. 8 is a cross-sectional view of the electrical connector and the flexible circuit board shown in FIG. 6, and shown that the electrical connector is in a fixing state and the connecting legs of the contacts sandwich the flexible circuit board.
Figure 9:
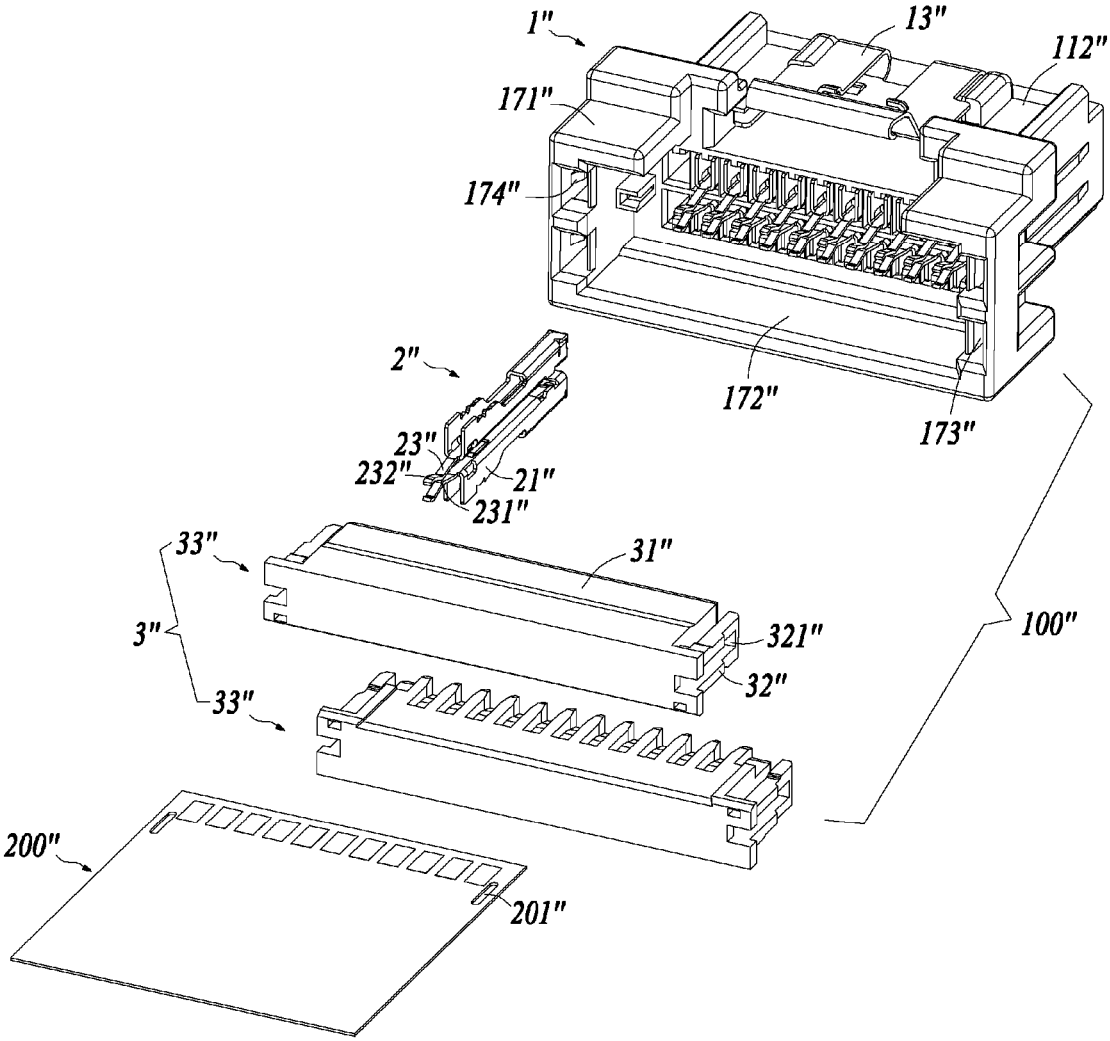
FIG. 9 is a partially exploded view illustrating a third embodiment of an electrical connector and a flexible circuit board in the present disclosure.
Figure 10:
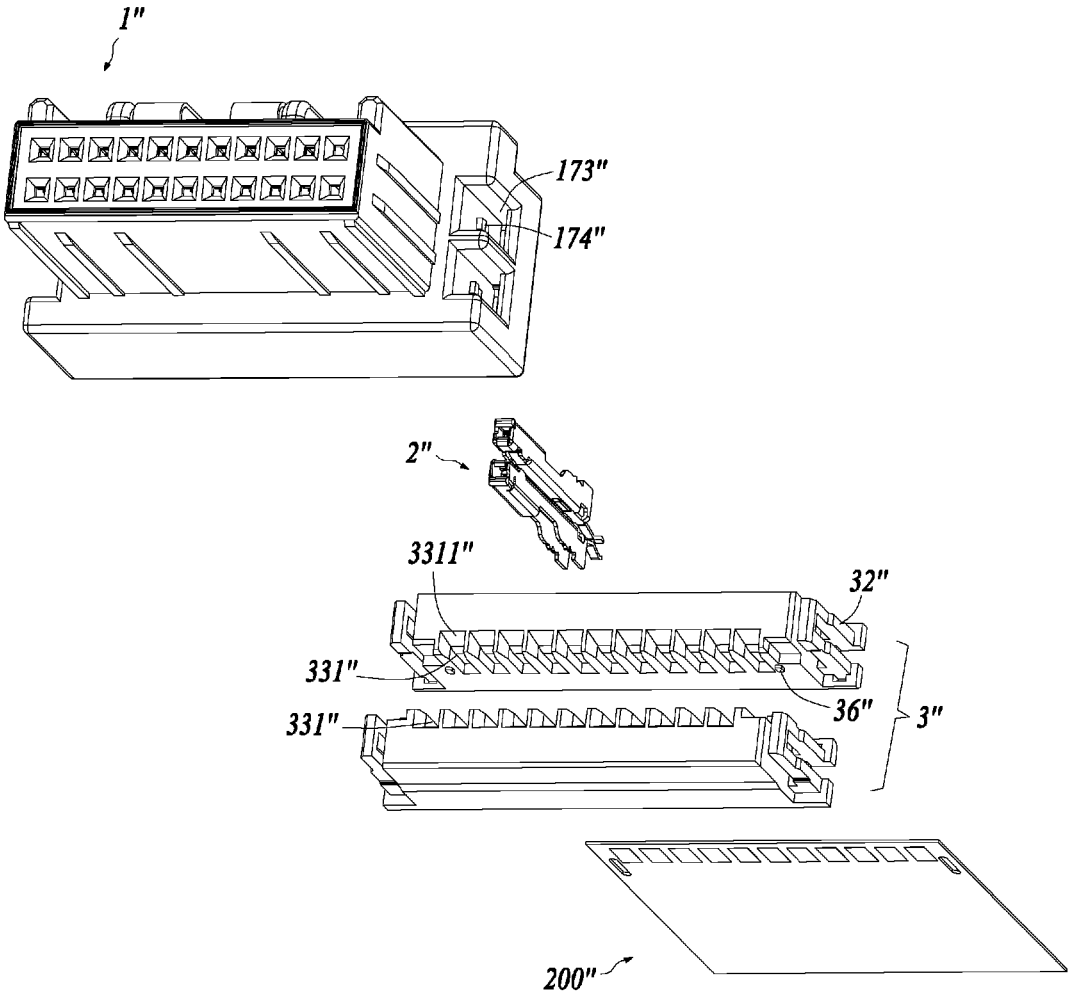
FIG. 10 is a view similar to FIG. 9, while viewed from another aspect.
Figure 11:
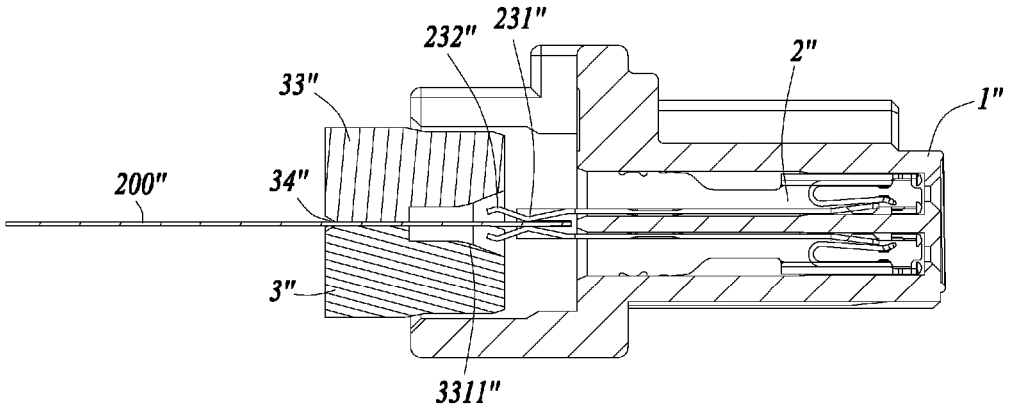
FIG. 11 is a cross-sectional view of the electrical connector and the flexible circuit board shown in FIG. 9, and shown that the electrical connector is in a pre-fixing state and the connecting legs of the contacts do not sandwich the flexible circuit board.
Figure 12:
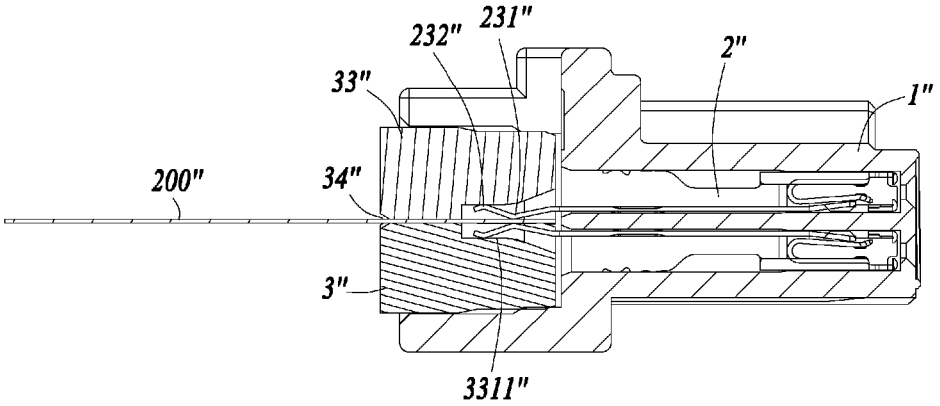
FIG. 12 is a cross-sectional view of the electrical connector and the flexible circuit board shown in FIG. 9, and shown that the electrical connector is in a fixing state and the connecting legs of the contacts sandwich the flexible circuit board.

Referring to FIGS. 6 to 8, in accordance with a second preferred embodiment of the present invention, an electrical connector 100' also comprise an insulative housing 1', a plurality of contacts 2' and a fastener 3'. The electrical connector 100' is similar to that in the first embodiment with the following exception.

The fixing holes 151' of the enlarged portion 15' are adjacent to the side walls 114' of the insulative housing 1' in the second embodiment, and the enlarged portion 15' is not formed with said fixing plates 152. The fixing structure 14' in the second embodiment is presented as two fixing projections outwardly projecting into the fixing holes 151' from the side walls 114'.

Besides, different from the contacts 2 in the first embodiment, the connecting legs 23' of the contacts 2' in the second embodiment are arranged in two rows. Two rows of the connecting legs 23' define a holding space 230' therebetween. The connecting portions 231' protrude toward the holding space 230', and the resisting portions 232' extend away from the holding space 230'. The resisting portions 232' are located between the connecting portions 231' and the retaining portions 21'.

In the second embodiment, each contact 2' further has a U-shaped tail portion 24' backwardly extending from the retaining portions 21'. The tail portions 24' in the upper row opens upwardly, and the tail portions 24' in the lower row opens downwardly. The connecting legs 23 are torn and bended from a level wall of the tail portions 24'. The level wall is parallel to the top surface 112'.

Furthermore, the fastener 3' defines two contact receiving chambers 31' corresponding to two rows of the connecting legs 23'. The flexible circuit board receiving chamber 32' is located between said two contact receiving chambers 31'. The holding space 230' aligns with the flexible circuit board receiving chamber 32' along the front to back direction, and partially overlaps with the flexible circuit board receiving chamber 32' when the fastener 3' is positioned at the fixed position. Besides, the fastener 3' further has a plurality of grooves 34' to receive the side walls of the tail portions 24' and a plurality of blocks 35' between adjacent grooves 34'. The blocks 35' can be received in the inner side of tail portions 24' as the fastener 3' is fixed to the insulative housing 1'. The grooves 34', the contact receiving chambers 31' and the flexible circuit board receiving chamber 32' communicate with each other along the top to bottom direction. The inner wall of the blocks 35' exposed to the contact receiving chambers 31' acts as the press section 33'. As moving the fastener 3' to the fixed position, the press section 33' can press the resisting portions 232' toward the holding space 230' and make the connecting portions 231' sandwich the flexible circuit board 200'.

The fitting section 30' of the fastener 3' in the second embodiment is same to that in the first embodiment, and is formed with a fitting hole 301' to lock with the fixing structure 14'. Of course, the fitting section 30' can be alternatively designed as a pair of fixing arms each of which has a fitting protrusion to hook the fixing structure 14'.

The operation of the electrical connector 100' in the second embodiment is similar to that in the first embodiment. In detail, firstly, assembling the fastener 3' to the pre-fixed position to make the fastener 3' be pre-fixed by the fitting section 30' and the inner wall of the fixing hole 151';

secondly, inserting the flexible circuit board 200' into the holding space 230' from a rear side of the fastener 3' forwardly with zero insertion force, and making the golden fingers 202' of the flexible circuit board 200' correspond to the connecting portions 231'; thirdly, moving the fastener 3' from the pre-fixed position to the fixed position, the connecting portions 231' can be drove to connect with the golden fingers 202' of the flexible circuit board 200' gradually in the moving process, and the flexible circuit board 200' will be sandwiched between the connecting portions 231' finally, and the fastener 3' is maintained at the fixed position by the fixing structure 14' and the fitting section 30'.

Referring to FIGS. 9 to 12, in accordance with a third preferred embodiment of the present invention, an electrical connector 100" comprise an insulative housing 1", a plurality of contacts 2" and a fastener 3" which are similar to that in the second embodiment. However, there is some difference being described in detail hereinafter.

The latching arm 13" on the top side of the insulative housing 1" is made from metal material and is installed on the top surface 112". Besides, the insulative housing 1" does not have said enlarged portion 15', but has four extension walls 171" spreading outwardly and backwardly from four sides of the rear surface 115", and a fixing space 172" defined between the extension walls 171". Each extension wall 171" located at the lateral side is provided with a fixing hole 173" and a pair of fixing blocks 174" projecting into the fixing hole 173" from opposite inner side walls of the fixing hole 173". The fixing blocks 174" in each fixing hole 173" are arranged in the front to back direction. In each fixing hole 173", one fixing block 174" located at front acts as the fixing structure, and another fixing block 174" acts as a pre-fixing structure to position the fastener 3" to the pre-fixed position.

The arrangement of the contacts 2" is same to that in the second embodiment. However, the contact 2" does not have said U-shaped tail portion, and the connecting legs 23" extend from the retaining portion 21" directly. Besides, the connecting portions 231" are located between the retaining portions 21" and the resisting portions 232".

The fastener 3" in the present embodiment has a body portion 31" and two pairs of fixing arms 32" arranged at two sides of the body portion 31". The fixing arms 32" act as the fitting section and are formed with elongated fitting holes 321". The fitting holes 321" can lock with the fixing blocks 174" at the pre-fixed position and the fixed position respectively.

The fastener 3" can be molded unitarily, and under this condition, the limiting element is designed as corresponding structure in the following fifth embodiment.

In the third embodiment, the fastener 3" compose of two insulators 33" which overlap each other along the top to bottom direction. Each insulator 33" is provided with a middle portion and a pair of said fixing arms 32" at two sides of the middle portion. The middle portions of two insulators 33" constitute the body portion 31". The insulative housing 1" has two groups of said fixing hole 173" and fixing blocks 174" at two sides thereof to engage with the fixing arms 32" of two insulators 33" respectively. Besides, each insulator 33" is formed with one contact receiving chamber 331". In the present embodiment, the contact receiving chamber 331" composes of a plurality of slots corresponding to the connecting legs 23" and a plurality of partition walls between adjacent slots. The flexible circuit board receiving chamber 34" is set between two insulators 33". The slots communicate with the flexible circuit board receiving chamber 34". The press section 3311" in the third embodiment is presented as the inner walls of the slots.

Besides, in the third embodiment, the limiting elements are designed on the fastener 3" and are presented as a pair of protrusions 36" protruding into the flexible circuit board receiving chamber 34" from at least one insulator 33". The flexible circuit board 200" defines a pair of elongated openings 201" at two sides thereof.

In using, firstly, assembling the insulators 33" to the pre-fixed position, the insulators 33" can be pre-fixed via the engagement of the pre-fixing structure and the fitting section; secondly, inserting the flexible circuit board 200" through the flexible circuit board receiving chamber 34" with zero insertion force, then the protrusions 36" are received in the openings 201" to limit the flexible circuit board 200" from moving backwardly; thirdly, moving two insulators 33" to the fixed position simultaneously, the press section 3311" presses the resisting portions 232" and drives the connecting portions 231" to sandwich the flexible circuit board 200" gradually in the moving process.

Besides, two insulators 33" can be alternatively provided with locking structures at two sides thereof, and the insulators 33" can be locked with each other before being assembled to the pre-fixed position.

Figure 13:
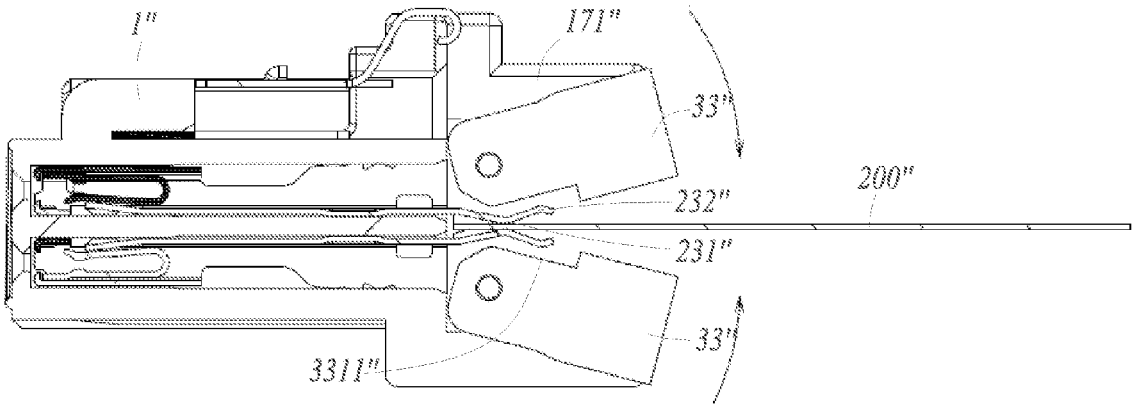
FIG. 13 is a cross-sectional view illustrating another embodiment of an electrical connector and a flexible circuit board, and shown that the electrical connector is in a pre-fixing state and the connecting legs of the contacts do not sandwich the flexible circuit board.
Figure 14:
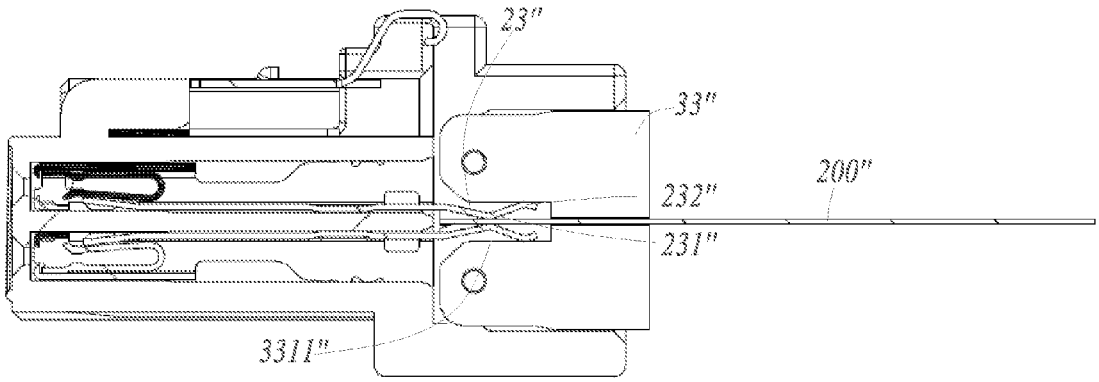
FIG. 14 is a cross-sectional view of the electrical connector and the flexible circuit board shown in FIG. 14, and shown that the electrical connector is in a fixing state and the connecting legs of the contacts sandwich the flexible circuit board.
Figure 15:
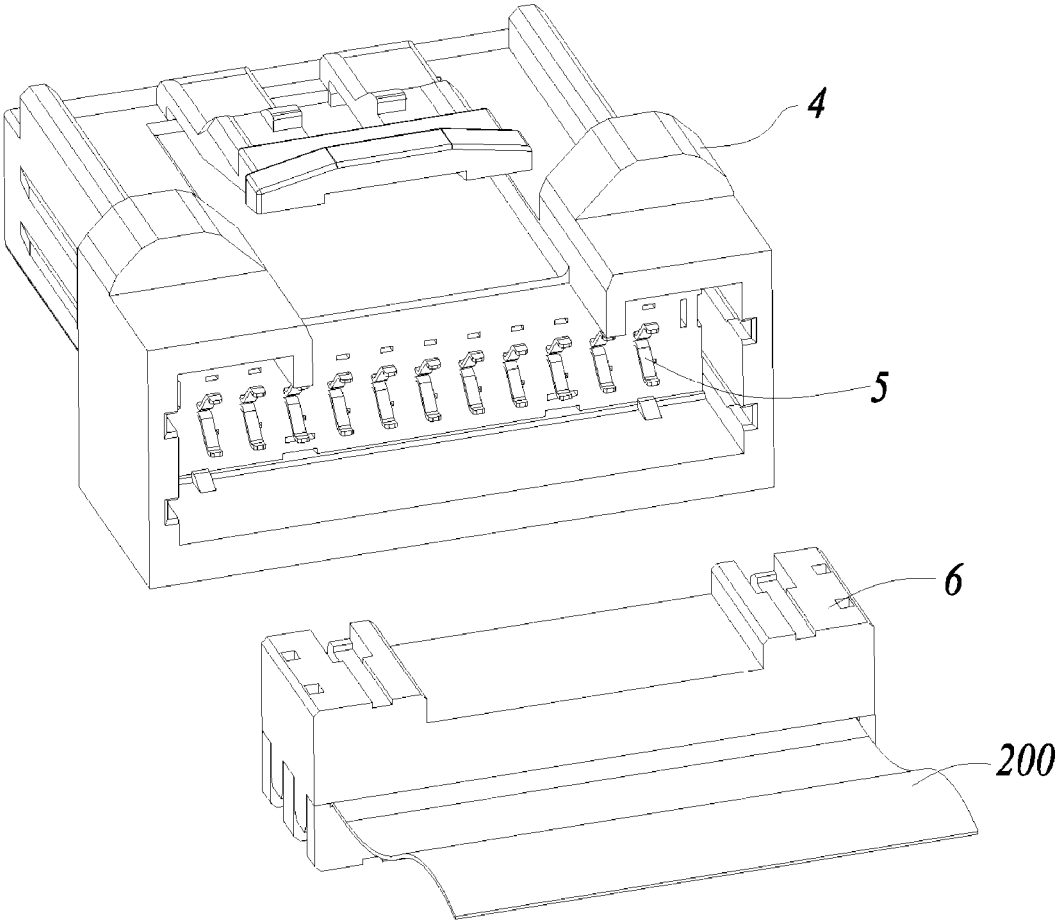
FIG. 15 is a partially exploded view illustrating a fourth embodiment of an electrical connector and a flexible circuit board in the present disclosure.
Figure 16:
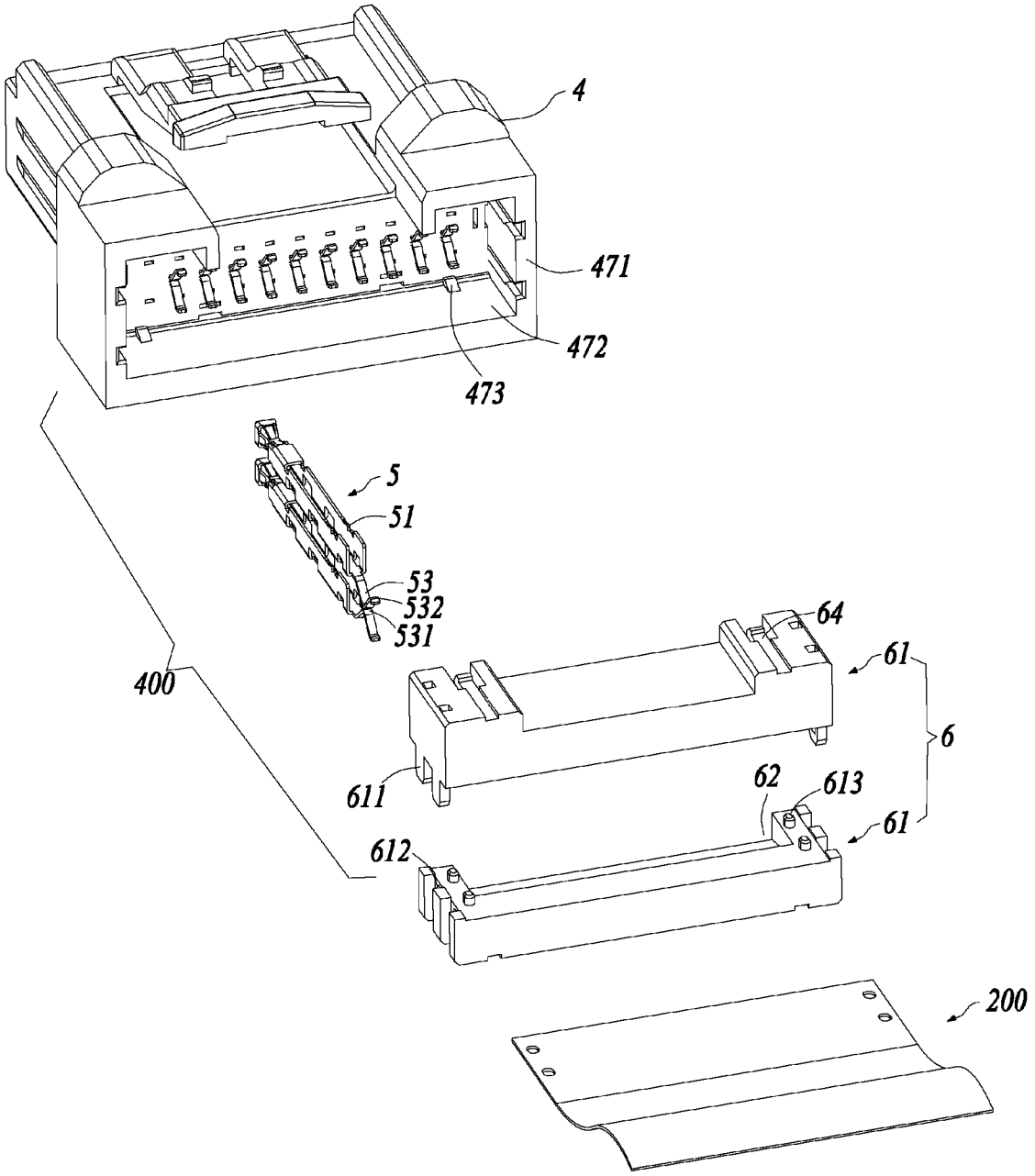
FIG. 16 is a further exploded view of the electrical connector and the flexible circuit board shown in FIG. 15.
Figure 17:
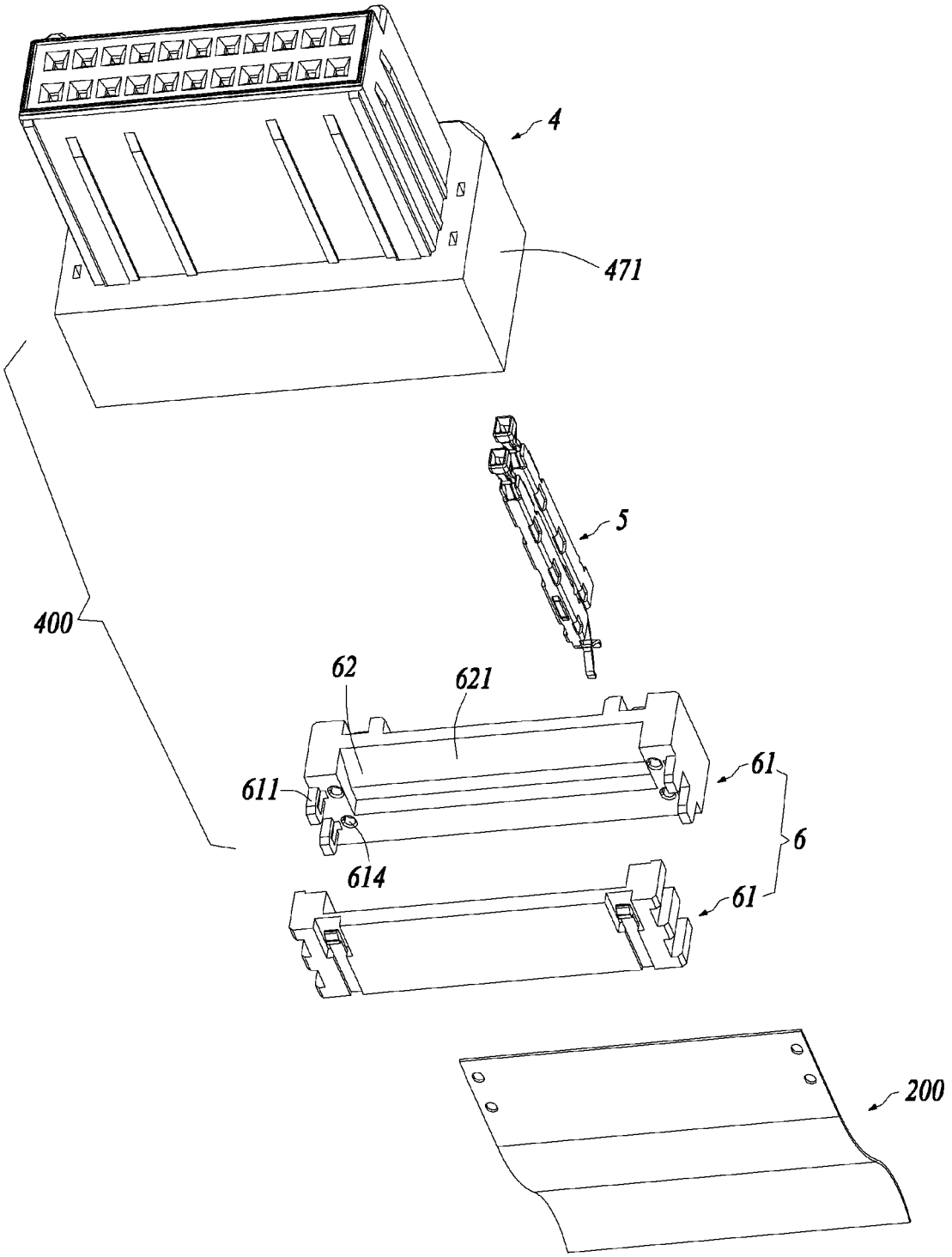
FIG. 17 is a view similar to FIG. 16, while viewed from another aspect.
Figure 18:
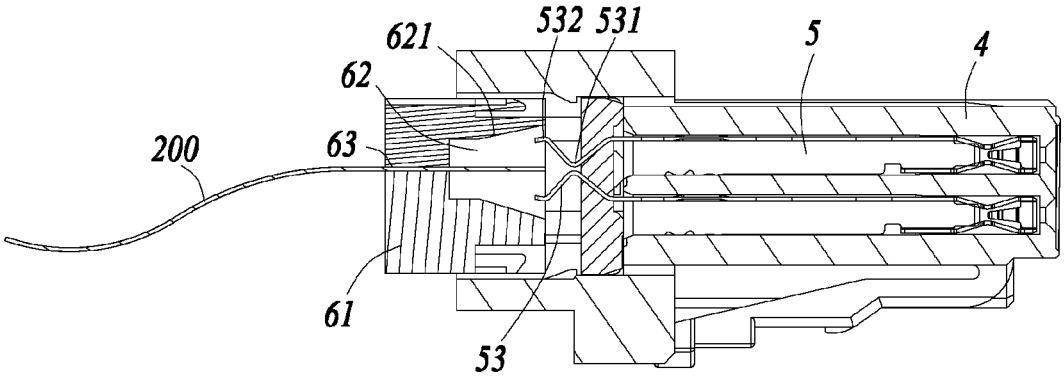
FIG. 18 is a cross-sectional view of the electrical connector and the flexible circuit board shown in FIG. 15, and shown that the electrical connector is in a pre-fixing state and the connecting legs of the contacts do not sandwich the flexible circuit board.
Figure 19:
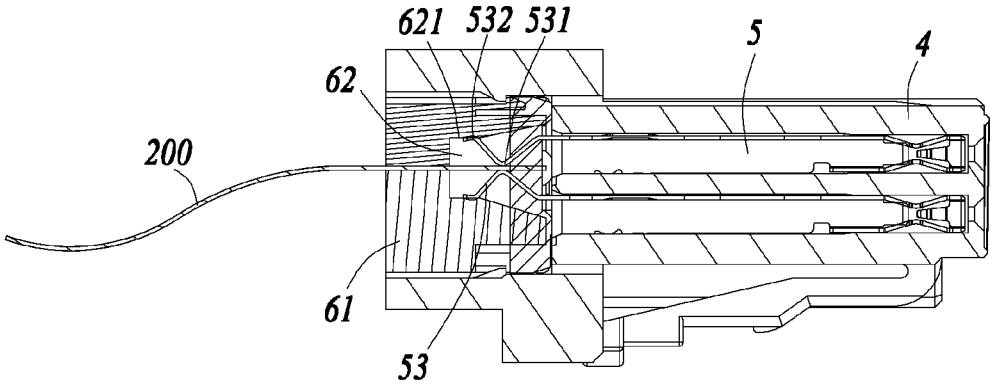
FIG. 19 is a cross-sectional view of the electrical connector and the flexible circuit board shown in FIG. 15, and shown that the electrical connector is in a fixing state and the connecting legs of the contacts sandwich the flexible circuit board.
Figure 20:
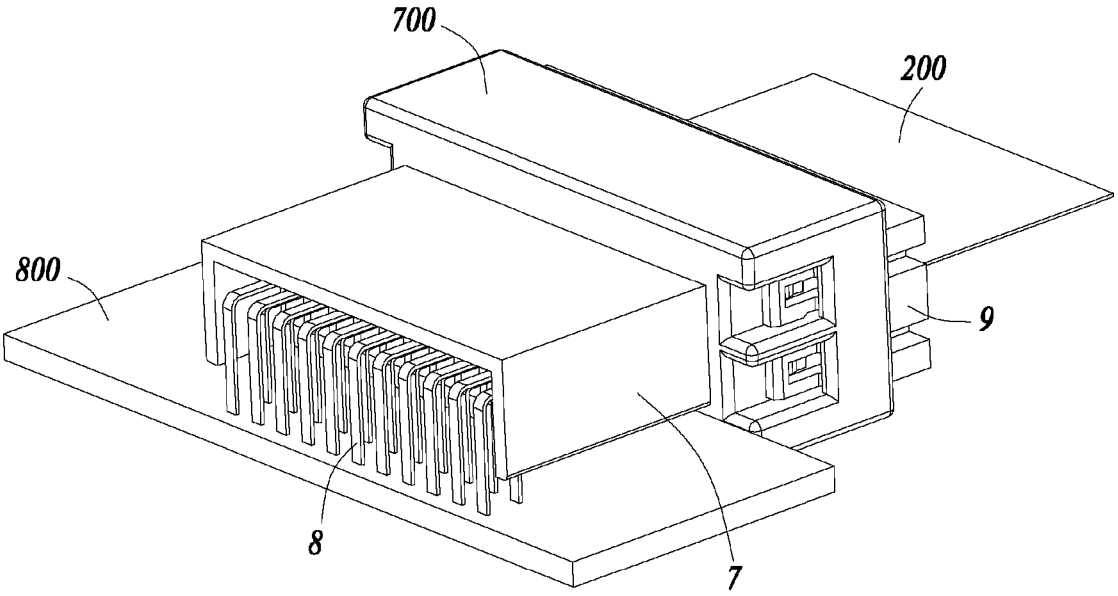
FIG. 20 is a perspective view illustrating a fifth embodiment of an electrical connector connected with a flexible circuit board in the present disclosure.
Figure 21:
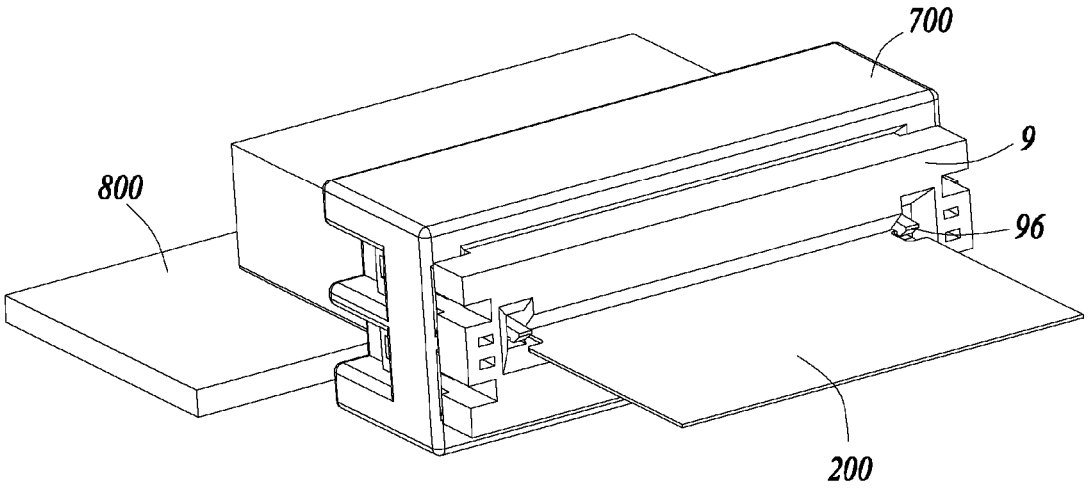
FIG. 21 is a view similar to FIG. 20, while viewed from another aspect.
Figure 22:
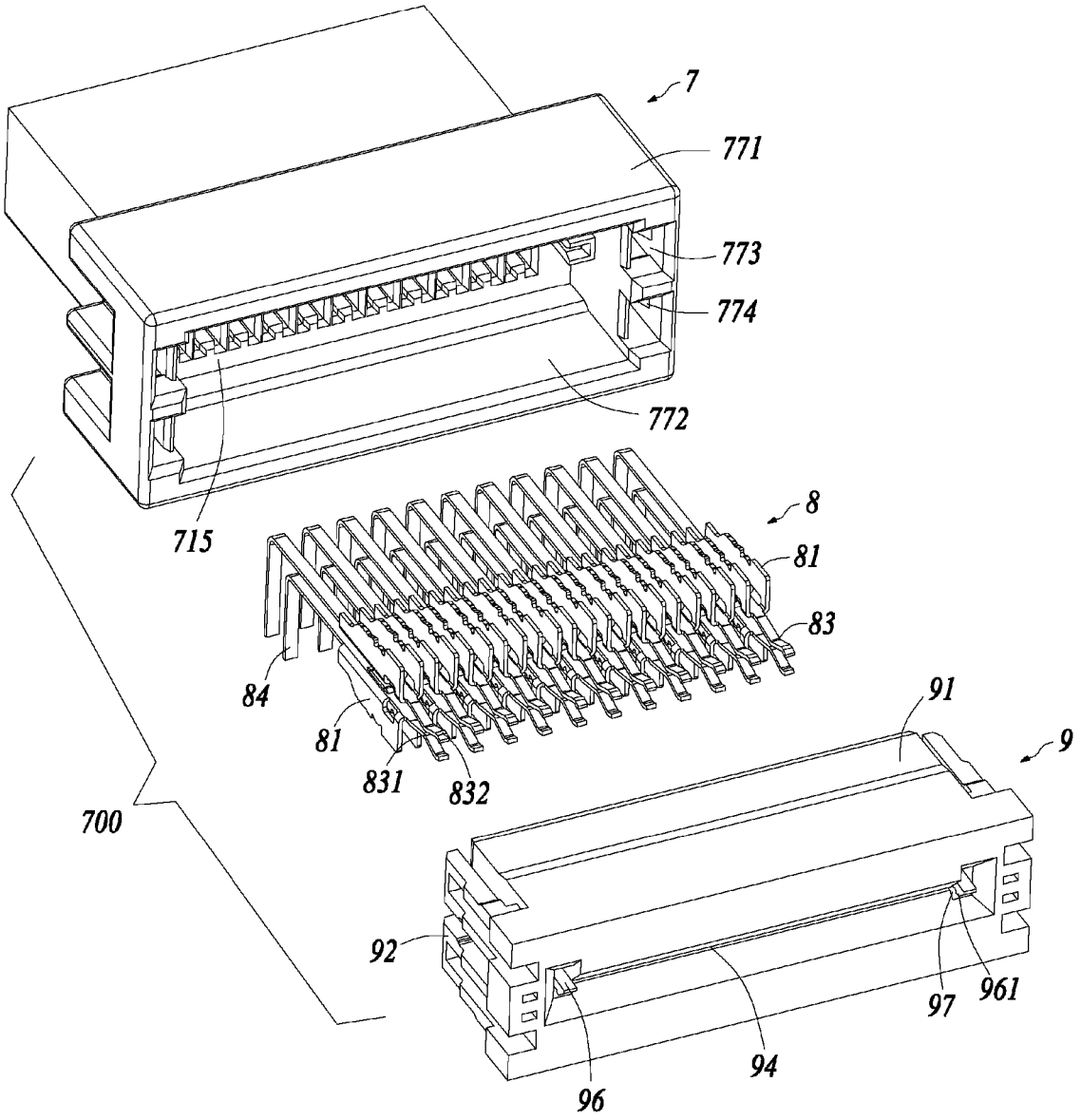
FIG. 22 is an exploded view of the electrical connector shown in FIG. 20.
Figure 23:
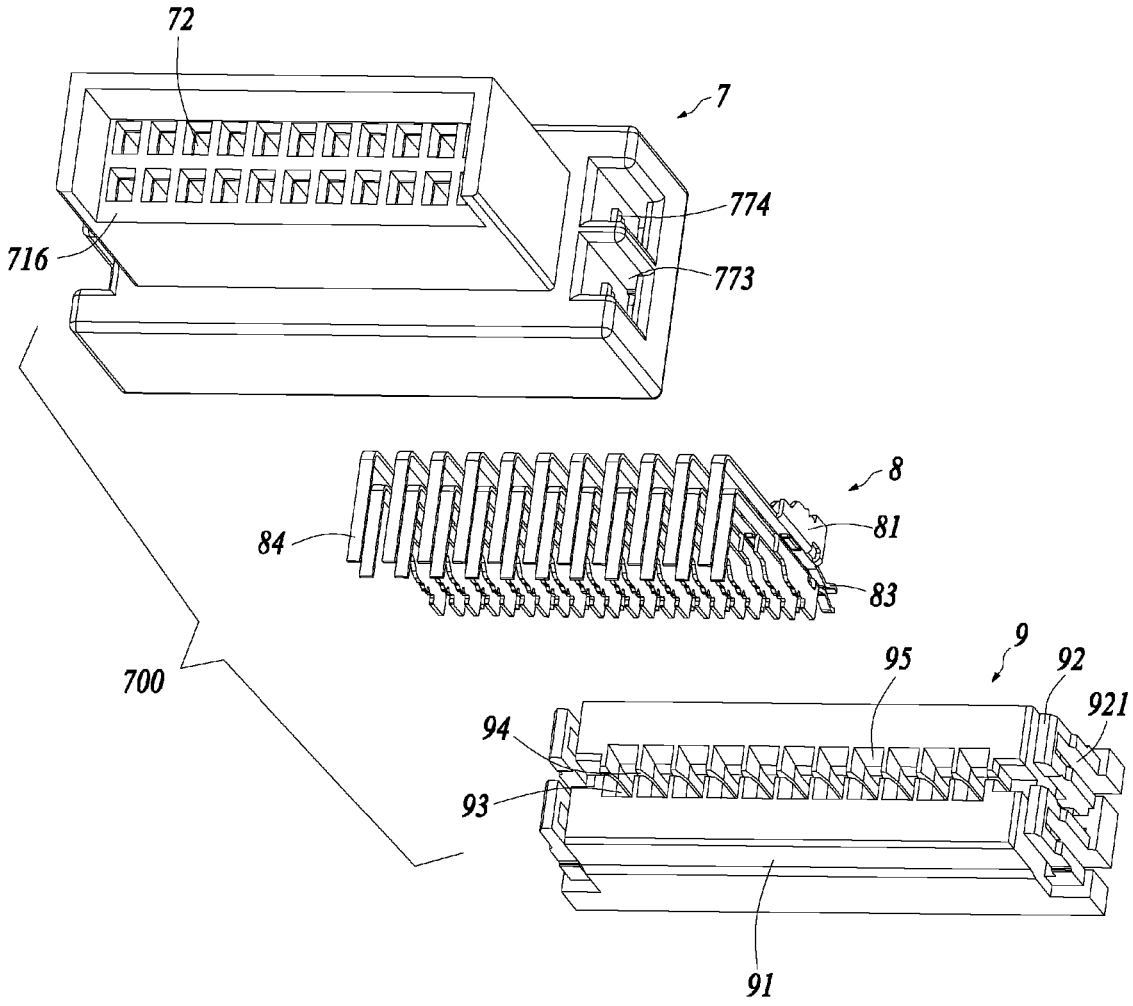
FIG. 23 is a view similar to FIG. 22, while viewed from another aspect.
Figure 24:
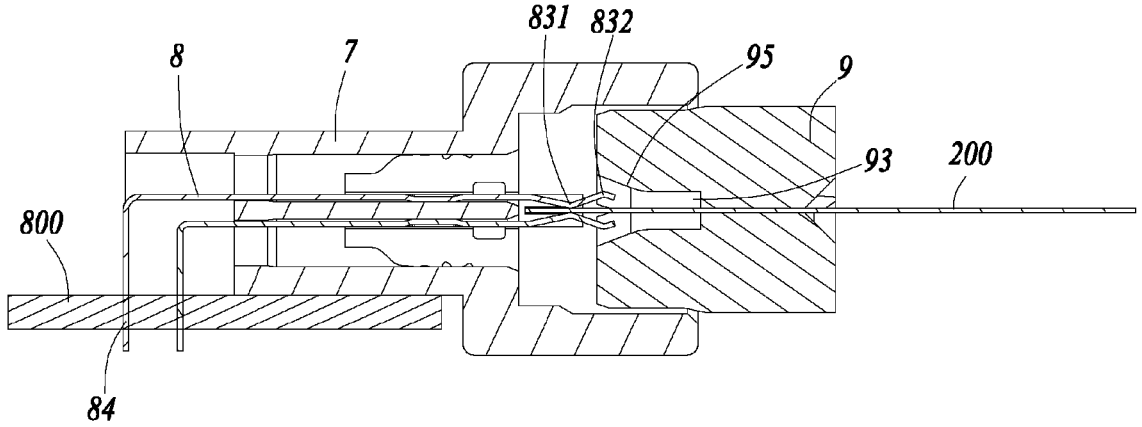
FIG. 24 is a cross-sectional view of the electrical connector and the flexible circuit board shown in FIG. 20, and shown that the electrical connector is in a pre-fixing state and the connecting legs of the contacts do not sandwich the flexible circuit board.
Figure 25:
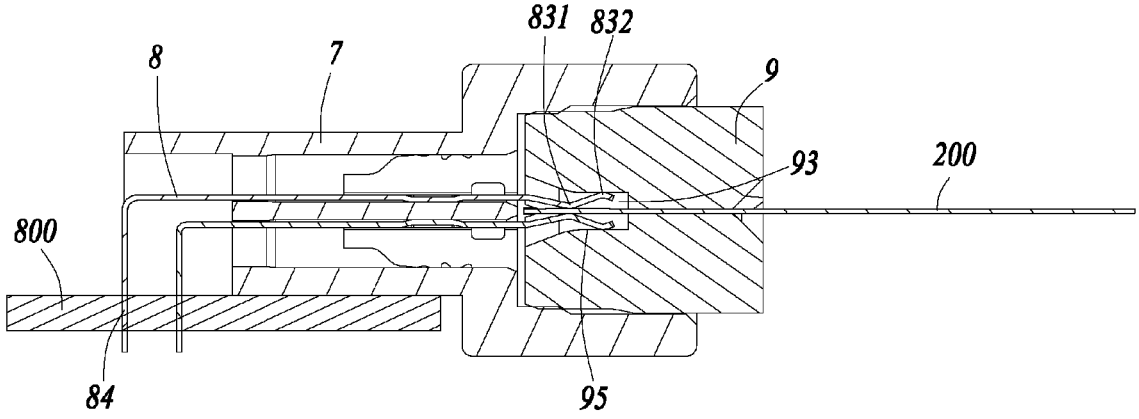
FIG. 25 is a cross-sectional view of the electrical connector and the flexible circuit board shown in FIG. 20, and shown that the electrical connector is in a fixing state and the connecting legs of the contacts sandwich the flexible circuit board.

In addition, referring to FIGS. 13 and 14, in accordance with another preferred embodiment of the present invention, different from the third embodiment, the insulators 33" and the insulative housing 1" can be alternatively designed without said fixing blocks 174" and the fixing arms 32", and make the insulators 33" be rotatably retained on the extension walls 171" of the insulative hosing 1". The insulators 33" are formed with locking structures at two sides thereof or rear side thereof to lock the insulators 33" together at the fixed position. The rotatable directions of two insulators 33" are opposite. In assembling, rotating the insulators 33" outwardly firstly, then inserting the flexible circuit board 200" with zero insertion force; secondly, rotating two insulators 33" inwardly, then the press section 3311" presses the resisting portions 232" and drives the connecting portions 231" to sandwich the flexible circuit board 200" gradually, and the insulators 33" lock with each other via the locking structures.

Referring to FIGS. 15 to 19, in accordance with a fourth preferred embodiment of the present invention, an electrical connector 400 comprise an insulative housing 4, a plurality of contacts 5 and a fastener 6 which are similar to that in the third embodiment, with the following exception.

The insulative housing 4 is also provided with four extension walls 471 spreading outwardly and backwardly from four sides of the rear surface 415, and a fixing space 472 defined between the extension walls 471. The extension walls 471 do not have said fixing hole 173" and fixing blocks 174", but has two pairs of fixing blocks 473 protruding into the fixing space 472 from the top and bottom extension walls 471. The fixing blocks 473 act as the fixing structure for fixing the fastener 6 to the fixed position. The fixing space 472 behind the fixing blocks 473 acts as the pre-fixed structure.

The arrangement of the contacts 5 is similar to that in the third embodiment. However, the retaining portions 21" of two rows contacts 2" in the third embodiment are set back to back, the retaining portions 51 of the contacts 5 in the fourth embodiment are set in a common direction. The connecting portions 52 extend from a same position of the retaining portions 51. Therefore, the distance between the connecting portions 52 in two rows is larger than that in the third embodiment. The connecting portions 531 are located between the retaining portions 51 and the resisting portions 532.

In the fourth embodiment, the fastener 6 is also comprised of two insulators 61 which overlap each other along the top to bottom direction. The insulators 61 are formed with latches 611 and projections 612 at two sides thereof to fix them together. The latches 611 and projections 612 constitute said locking structures. Each insulator 61 defines a contact receiving chamber 62 recessed from the front end thereof and presented as a long groove extending along a transverse direction. The flexible circuit board receiving chamber 63 is formed between the contact receiving chambers 62. The contact receiving chambers 62 open toward the flexible circuit board receiving chamber 63. Each insulator 61 has a press section 621. The press section 621 is also presented as an inner wall of the contact receiving chamber 62 away from the flexible circuit board receiving chamber 63.

Besides, the fitting section in the fourth embodiment is presented as a pair of fixing arms 64 formed at an outer wall of each insulator 61. The fixing arms 64 engage with the fixing blocks 473 for locking the fastener 6 to the fixed position. The limiting elements are presented as a plurality of posts 613 protruding from one insulator 61 to another insulator 61. Said another insulator 61 is formed with a plurality of holes 614 to engage with the posts 613.

In using, firstly, fixing the flexible circuit board 200 to said one insulator 61 by the posts 613; secondly, locking two insulators 61 together by the latches 611 and projections 612; then moving the fastener 6 and the flexible circuit board 200 from a rear side of the fixing space 472 forwardly until being fixed at the fixed position. The press sections 621 of two insulators 61 press the resisting portions 532 and drive the connecting portions 531 to sandwich the flexible circuit board 200 in the moving process.

Referring to FIGS. 20 to 25, in accordance with a fifth preferred embodiment of the present invention, an electrical connector 700 is used to connect a circuit board 800 and said flexible circuit board 200, and also comprise an insulative housing 7, a plurality of contacts 8 and a fastener 9.

The insulative housing 7 is similar to that in the third embodiment, and has four extension walls 771, a fixing space 772, two pairs of fixing holes 773 and fixing blocks 774 which are all same to that in the third embodiment. Besides, the insulative housing 7 further has a front surface 716 opposite to the rear surface 715 and a plurality of passageways 72 extending therethrough. The front surface 716 can be the front end surface or a surface behind the front end surface.

Different from the third embodiment, the contacts 8 are assembled to the insulative housing 7 from the front surface 716 backwardly. Each contact 8 has a retaining portion 81 retained in the passageway 72, a soldering portion 84 extending out of the front surface 716 from the front end of the retaining portion 81, a connecting leg 83 extending beyond the rear surface 715 from the rear end of the retaining portion 81. The soldering portions 84 are used to connect with the circuit board 800, and the connecting legs 83 are used to connect with the flexible circuit board 200. The circuit board 800 and the flexible circuit board 200 can be electrically connected by the contacts 8. The design of the connecting legs 83 is same to that in the third embodiment, there will not be described hereinafter.

The fastener 9 in the fourth embodiment is molded unitarily, and has a body portion 91 and two pairs of fixing arms 92 at two sides of the body portion 91. The body portion 91 defines two contact receiving chambers 93 corresponding to two rows of contacts 8, a flexible circuit board receiving chamber 94 between the contact receiving chambers 93, and press sections 95. The press sections 95 are presented as the inner walls of the contact receiving chamber 93 and far from the flexible circuit board receiving chamber 94. The fixing arms 92 act as the fitting section and are formed with fitting holes 921. The fitting holes 921 engage with the fixing blocks 774 at the pre-fixed position or fixed position.

Besides, the fastener 9 is also provided with a pair of limiting elements. The limiting elements are presented as a pair of spring arms 96 extending backwardly at outsides of the contact receiving chambers 93. Each spring arm 96 is formed with a protrusion 961 protruding into the flexible circuit board receiving chamber 94 from a free end thereof. The inner wall of the flexible circuit board receiving chamber 94 defines a pair of recess 97 corresponding to the protrusions 961.

In assembly, firstly, assembling the fastener 9 to the pre-fixed position; secondly, soldering the electrical connector 700 to the circuit board 800; thirdly, assembling the flexible circuit board 200 to the electrical connector 700 forwardly from a rear side of the fastener 9 and making the flexible circuit board 200 extend between the connecting legs 831; finally, moving the fastener 9 to the fixed position, then the press sections 95 press the resisting portions 832 and drive the connecting portions 831 to sandwich the flexible circuit board 200.

In summary, the flexible circuit board 200, 200', 200" and the contact 2, 2', 2", 5, 8 can connect with each other without welding, and the connecting can be stably maintained by the engagement of the fastener 3, 3', 3", 6, 9 and the insulative housing 1, 1', 1", 4, 7. Beside, the design of the electrical connector 100, 100', 100", 400, 700 is simple and convenient to assemble and position.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector, comprising:

an insulative housing having a top surface, a bottom surface and a rear surface;

a plurality of contacts retained in the insulative housing, each contact having a connecting leg extending beyond the rear surface, the connecting legs of the contacts being arranged in at least a row, each connecting leg has a connecting portion and a resisting portion adjacent to the connecting portion, the vertical distance between the connecting portion and the top wall being different from that between the resisting portion and the top wall;

a fastener having at least a contact receiving chamber, a flexible circuit board receiving chamber communicating with the contact receiving chamber and a press section, the contact receiving chamber being arranged between from the flexible circuit board receiving chamber and the press section, the resisting portion being far from the flexible circuit board receiving chamber than the connecting portion, and abutting against the press section when the fastener is fixed to the insulative housing;

wherein the fastener has a fixed position on the insulative housing, and as moving the fastener to the fixed position, the press section presses the resisting portion to drive the connecting portion projecting into the flexible circuit board receiving chamber.

2. The electrical connector as claimed in claim 1, wherein the connecting legs are arranged in two rows along a top to bottom direction and define a holding space therebetween, the connecting portions protrude toward the holding space, and the resisting portions extend away from the holding space, the fastener is provided with two said contact receiving chambers corresponding two rows of connecting legs, and the flexible circuit board receiving chamber is located between the contact receiving chambers, the holding space and the flexible circuit board receiving chamber are partially overlapped.

3. The electrical connector as claimed in claim 1, wherein the insulative housing is provided with a fixing structure, the fastener is formed with a fitting section to fit with the fixing structure at the fixed position.

4. The electrical connector as claimed in claim 3, wherein the insulative housing has an enlarged portion at a rear side thereof, the enlarged portion is provided with a pair of fixing holes at two sides of the insulative housing, and a pair of fixing plate extending forwardly from the internal walls of the fixing holes, the fixing structure is formed on the fixing plates and presented as a pair of fixing projections projecting outwardly, the fitting section is presented as a pair fixing arms extending forwardly from two sides of the fastener, each fixing arm is provided with a fitting hole or a fitting projection to fit with the fixing projections.

5. The electrical connector as claimed in claim 3, wherein the fixing structure is presented as a pair of fixing projections extending outwardly from two sides of the insulative housing, the fitting section is presented as a pair of fixing arms extending forwardly from two sides of the fastener, each fixing arm is provided with a fitting hole or a fitting projection to fit with the fixing projections.

6. The electrical connector as claimed in claim 3, wherein the insulative housing has four extension walls spreading outwardly and backwardly from four sides of the rear surface and a fixing space between the extension walls to receive the fastener, the fixing structure is presented as a plurality of fixing protrusions protruding into the fixing space from the extension walls, the fitting section is presented as a pair of fixing arms to fix with the fixing protrusions.

7. The electrical connector as claimed in claim 3, wherein the fastener further has a pre-fixed position on the insulative housing, the pre-fixed position is located behind the fixed position, and when the fastener is located at the pre-fixed position, the free ends of the connecting legs protrude into a front side of the contact receiving chamber, and the press section aligns to the resisting portion in the top to bottom direction and does not press the resisting portion.

8. The electrical connector as claimed in claim 7, wherein the insulative housing has two extension walls backwardly extending from two sides of the rear surface and a fixing space between the extension walls to receive the fastener, each extension wall is formed with a fixing hole extending therethrough along a front to back direction and a pair of fixing blocks projecting into the position hole from the internal side walls of each position hole, the fixing blocks in each fixing hole are arranged in the front to back direction, and one fixing block located at front acts as a pre-fixing structure to pre-fix the fastener to the pre-fixed position, and another fixing block acts as said fixing structure, the fastener has a body portion and a pair of fixing arms forwardly extending from two sides of the body portion, the fixing arms act as the fitting section and engage with the fixing blocks at the pre-fixed position and the fixed position respectively.

9. The electrical connector as claimed in claim 8, wherein the fixing blocks in each position hole project from opposite two internal side walls of the position hole.

10. The electrical connector as claimed in claim 2, wherein the insulative housing or the fastener is further formed with a pair of limiting elements to lock a flexible circuit board and prevent the flexible circuit board from moving backwardly.

11. The electrical connector as claimed in claim 10, wherein when the limiting elements are formed on the insulative housing, the limiting elements has a spring arm and a supporting arm backwardly extending from the rear surface of the insulative housing, the spring arm and the supporting arm align with each other along the top to bottom direction, each spring arm is provided with a protrusion for positioning the flexible circuit board, the spring arms and the supporting arms defines a gap therebetween to receive the flexible circuit board, the supporting arm defines a recess corresponding to the protrusion.

12. The electrical connector as claimed in claim 10, wherein the fastener is molded unitarily, when the limiting element is formed on the fastener, the fastener has a pair of spring arms located at outsides of the contact receiving chamber, the spring arm is formed with a protrusion extending into the flexible circuit board receiving chamber at a free end thereof, the fastener further defines a recess recessed from an internal wall of the flexible circuit board receiving chamber, the recess is opposite to the protrusion.

13. The electrical connector as claimed in claim 10, wherein the fastener composes of two insulators which overlap each other along the top to bottom direction, each insulator is formed with one said contact receiving chamber, said flexible circuit board receiving chamber is located between said insulators, and the limiting element protrudes into the flexible circuit board receiving chamber from at least one insulator.

14. The electrical connector as claimed in claim 13, wherein the insulators are formed with locking structures at two sides thereof, and the insulators are locked with each other before being assembled to the fixed position of the insulative housing.

15. The electrical connector as claimed in claim 13, wherein the insulators are rotatably retained on the insulative housing and formed with locking structures at two sides or rear sides thereof to lock them at the fixed position, the rotatable directions of two insulators are opposite.

16. The electrical connector as claimed in claim 1, wherein the insulative housing defines a plurality of passageways extending there through along a front to back direction, the contacts are assembled to the insulative housing from the rear surface forwardly, and each contact has a retaining portion retained in the passageways and a contact portion forwardly extending from the retaining portion.

17. The electrical connector as claimed in claim 1, wherein the insulative housing further has a mating surface opposite to the rear surface and a plurality of passageways extending therethrough, the contacts are assembled to the insulative housing from the mating surface backwardly, and each contact has a retaining portion retained in the passageways, a contact portion forwardly extending from the retaining portion.

18. The electrical connector as claimed in claim 3, wherein the insulative housing or the fastener is further formed with a pair of limiting elements to lock a flexible circuit board and prevent the flexible circuit board from moving backwardly.

19. The electrical connector as claimed in claim 7, wherein the insulative housing or the fastener is further formed with a pair of limiting elements to lock a flexible circuit board and prevent the flexible circuit board from moving backwardly.

* * * * *